US007821374B2

(12) United States Patent
Harrison et al.

(10) Patent No.: US 7,821,374 B2
(45) Date of Patent: Oct. 26, 2010

(54) WIDEBAND PLANAR TRANSFORMER

(75) Inventors: William Lee Harrison, El Dorado Hills, CA (US); Stephen M. McConnell, Folsom, CA (US); Anh-Vu Pham, West Sacramento, CA (US)

(73) Assignee: KeyEye Communications, Sacramento, CA (US)

( * ) Notice: Subject to any disclaimer, the term of this patent is extended or adjusted under 35 U.S.C. 154(b) by 321 days.

(21) Appl. No.: 12/006,822

(22) Filed: Jan. 4, 2008

(65) Prior Publication Data

US 2009/0002111 A1 Jan. 1, 2009

Related U.S. Application Data

(60) Provisional application No. 60/880,208, filed on Jan. 11, 2007.

(51) Int. Cl.

| | |
|---|---|
| ***H01F 27/28*** | (2006.01) |
| ***H01F 29/00*** | (2006.01) |
| ***H01F 27/29*** | (2006.01) |
| ***H01F 5/00*** | (2006.01) |

(52) U.S. Cl. ..... 336/229; 336/69; 336/192; 336/200; 336/232

(58) Field of Classification Search ..... 336/192, 336/200, 229, 232

See application file for complete search history.

(56) References Cited

U.S. PATENT DOCUMENTS 3,262,075 A * 7/1966 Podell ..... 333/32
3,263,191 A * 7/1966 Arvonio et al. ..... 333/24 R
3,453,574 A * 7/1969 De Parry ..... 336/182
3,486,149 A * 12/1969 Klein ..... 336/192
3,731,237 A * 5/1973 Beurrier ..... 333/24 R
3,881,244 A 5/1975 Kendall
4,767,355 A 8/1988 Phillipson et al.
4,824,383 A 4/1989 Lemke
5,169,324 A 12/1992 Lemke et al.
5,372,967 A 12/1994 Sundaram et al.
5,420,551 A * 5/1995 Conte et al. ..... 333/12
5,543,773 A * 8/1996 Evans et al. ..... 336/183
5,639,266 A 6/1997 Patel (Continued)

FOREIGN PATENT DOCUMENTS

JP 61019109 A * 1/1986

(Continued)

*Primary Examiner*—Elvin G Enad
*Assistant Examiner*—Tszfung Chan
(74) *Attorney, Agent, or Firm*—Lumen Patent Firm

(57) ABSTRACT

A method of arranging and fabricating parallel primary and secondary coils of a wideband planar transformer is provided. The spacing and width of the coils are disposed to extend the bandwidth from DC to GHz and allow for high frequency coupling when the core permeability dramatically drops and achieves low reflected energy and low loss over a wide bandwidth. A bottom mold having a pattern of hole-pairs with conductive elements inserted vertically couples to a top mold such that a middle portion of the conductive elements spans between the top and bottom molds. Dielectric material envelopes the middle portion and a displacement feature of the mold creates a vacancy. A ferrite element is deposited to the vacancy. A second top mold spans the bottom mold and dielectric material is deposited to create a molded assembly. A deposited patterned conductive coating connects the element ends to define the transformer coils.

6 Claims, 4 Drawing Sheets

U.S. PATENT DOCUMENTS 5,745,981 A 5/1998 Roshen et al.
5,781,091 A 7/1998 Krone et al.
5,825,259 A * 10/1998 Harpham ..... 333/22 R
5,879,194 A 3/1999 Thenaisie et al.
5,959,846 A 9/1999 Noguchi et al.
6,036,550 A 3/2000 Naganawa et al.
6,065,991 A 5/2000 Fukuda
6,103,405 A 8/2000 Tomita
6,139,350 A 10/2000 Mathesius
6,148,500 A 11/2000 Krone et al.
6,176,741 B1 1/2001 Shutter
6,267,628 B1 7/2001 Meckley et al.
6,324,067 B1 11/2001 Nishiyama
6,419,526 B1 7/2002 Fair et al.
6,535,085 B2 3/2003 Song et al.
6,540,563 B1 4/2003 Hu et al.
6,554,368 B2 4/2003 Drake et al.
6,579,127 B2 6/2003 Hess et al.
6,583,705 B2 * 6/2003 Schutten et al. ..... 336/229
6,593,836 B1 7/2003 LaFleur et al.
6,686,824 B1 2/2004 Yamamoto
6,749,467 B2 6/2004 Korsunsky et al.
6,768,409 B2 7/2004 Inoue et al.
6,769,936 B2 8/2004 Gutierrez et al.
6,773,302 B2 8/2004 Gutierrez et al.
6,820,321 B2 11/2004 Harding
6,878,012 B2 4/2005 Gutierrez et al.
6,940,385 B2 9/2005 Kusano
6,964,585 B2 11/2005 Blichasz et al.
7,135,952 B2 11/2006 Harding
7,196,607 B2 3/2007 Pieskach et al.
7,295,448 B2 11/2007 Zhu
7,297,013 B2 11/2007 Caveney et al.
7,436,282 B2 10/2008 Whittaker et al.
7,477,128 B2 1/2009 Quilici
2004/0085174 A1 * 5/2004 Decristofaro et al. ..... 336/178
2004/0113738 A1 6/2004 Ahn et al.
2004/0150502 A1 8/2004 Jacobson et al.
2004/0212475 A1 10/2004 Schumacher
2005/0113055 A1 * 5/2005 Nakagaki ..... 455/313
2006/0125586 A1 6/2006 Lee et al.
2007/0111598 A1 5/2007 Quilici
2007/0159282 A1 7/2007 Huang et al.
2008/0186119 A1 8/2008 Zou
2009/0077791 A1 3/2009 Quilici

FOREIGN PATENT DOCUMENTS

WO WO 97/08788 3/1997
WO WO 2005-099280 10/2005
WO WO 2006-063081 6/2006

* cited by examiner (e)

(f)

(g)

WIDEBAND PLANAR TRANSFORMER

CROSS-REFERENCE TO RELATED APPLICATIONS

This application is cross-referenced to and claims the benefit from U.S. Provisional Patent Application 60/880,208 filed Jan. 11, 2007, which is hereby incorporated by reference.

FIELD OF THE INVENTION

The invention relates generally to DC to multi-GHz's bandwidth magnetic-winding communications circuitry. More particularly, the invention relates to a method of arranging micro-fabricated windings with molded ferrite cores to specifically control leakage inductance and winding capacitance to achieve GHz performance and electrical consistency.

BACKGROUND

There has been much attention directed to planar or integrated transformers using PCB boards or semiconductors over the last ten years. Planar transformers are manufactured using a combination of embedded or attached ferrite materials and PCB techniques to improve the winding coupling. In the case of semiconductors, attempts are made to integrate the entire inductor or transformer structure into a CMOS device. Both of these methods have severe limitations, which restrict their use to low speed or narrow band applications. In the case of planar transformer designs prior art approaches fail to adequately address a method of arranging the windings to control leakage inductance and winding capacitance and its associated fabrication. As result, prior art planar transformers have poor return loss and insertion loss over a wide frequency range and are not functional and usable in many communication standards today. Transformers based on this prior art consistently fail to meet the technical requirements for data communications and are restricted to relatively low speed applications such as switching power supply systems. Integrated transformers are limited at the lower end of the band by the self inductance that primarily comes from a magnetic ferrite core with high permeability. Integration of magnetic materials onto Si tends to be difficult. Hence, Silicon transformers typically rely only on natural electromagnetic coupling and therefore typically provide narrow band performance at RF. Furthermore, integrated transformers suffer parasitic eddy currents generated by the magnetic fields in the silicon and have limited high frequency performance. As a result, integrated transformers typically have narrow bandpass characteristics and are only good for narrow frequency balun applications commonly found in wireless applications such as cellular phones. Telecom transformers require a bandpass response with a bandwidth from DC to as high as several GHz along with center taps used supplying DC power or for terminating common mode currents to reduce electromagnetic interferences. These center taps make it very difficult to achieve wide bandwidth performance.

Unlike low speed applications typically found in switching power supplies or narrow band applications typically found in wireless applications, networking and telecommunication applications typically use all of the available bandwidth in order to efficiently transfer data. Networking and telecommunications markets require linear wideband performance from near DC to multi-Gigahertz with very low loss and minimal reflected energy. Furthermore, the permeability of magnetic cores decreases as frequency increases into Gigahertz where new multi-gigabit communications applications demand the bandwidth. To compensate for the loss of magnetic coupling, the number of winding turns is increased. The increase in the number of turns induces significant leakage inductance and winding capacitance that degrade the transfer of energy and reflect significant energy. Designing multi-Gigahertz transformers to meet these stringent specifications requires several diverse techniques to be incorporated into the arrangement of the windings and associated fabrication of the planar design.

In addition, these devices must be manufactured in a manner that prevents them from breaking down in the presence of high voltage (>1500V) as electrical isolation is a critical reason why these devices are placed in series with the communications channel.

Accordingly, there is a need in the art to develop a transformer that can provide low reflected energy and electrical loss from DC to GHz for high-voltage DC isolation and low frequency common-mode rejection requirements of gigabit communications. It would be considered an advance of the art to arrange the windings that specifically control winding capacitance and leakage inductance to, lower reflected energy and extend the bandwidth from DC to GHz. Furthermore, these winding techniques and associated fabrication allow for GHz coupling where the permeability of a ferrite core drops drastically.

SUMMARY OF THE INVENTION

The current invention provides a method of arranging windings to minimize reflected energy and loss and fabrication techniques for the invented windings of a wideband planar transformer. According to one embodiment, the method provides for the inter-winding of the primary and the secondary turns so that the winding capacitance can be specifically designed for coupling up to GHz even when the permeability of the core significantly drops. A primary turn is inter-wound with an adjacent secondary turn with a spacing that can be specifically designed and controlled with micro-fabrication techniques. The primary and secondary turns are adjacent at the top, bottom and the two vertical sides. The adjacent primary and secondary turns wrap around the toroid from top to bottom to provide necessary coupling at GHz frequency. The number of turns, spacing between the primary and secondary turns and width of the each turns can all be accurately designed and adjusted to control the parasitic effects. The coupling between the primary and secondary turns can be adjusted accordingly to achieve the lowest reflected energy and loss. The center taps are an electrode connected to the middle of the primary and the secondary turns.

One aspect of the above embodiment, the number of the primary and secondary turns is an even number. On the primary side, one turn is open to provide the differential input. This leaves an odd number of turns on the primary side. The center tap is connected in the middle of the remaining odd primary turns. Hence, the number of turns on either side of the center tap is even or balanced. The same center tap configuration and turns are used on the secondary side. This arrangement of the turns and the center taps significantly minimizes the conversion of the differential mode to common mode signals to avoid EMI. According to one embodiment, the method includes providing a bottom mold that has a pattern of hole pairs disposed in a planar base of the bottom mold. Conductive elements are inserted to the holes, where the conductive elements are disposed vertically from the planar base, and a bottom portion of the conductive elements are held by the bottom mold. The method further includes providing a first top mold that is disposed on the bottom mold forming a first mold pair, where the first top mold has conductive element receiving features and a displacement feature disposed between the conductive element receiving features, such that a middle portion of the conductive elements spans between the first top mold and the bottom mold. A dielectric material is deposited to the first mold pair that envelopes the middle portion of the conductive elements and further envelopes the displacement feature. The first top mold is removed, where a vacancy is then revealed by removing the displacement feature. A ferrite element is deposited to the vacancy. A second top mold is provided to the bottom mold, where the second top mold and the bottom mold define a second mold pair, and the second top mold spans the bottom mold. The dielectric material is deposited to the second mold pair to create a molded assembly, where the dielectric material envelopes a top portion of the conductive element and envelopes the ferrite element. The molded assembly is removed from the second mold pair, where the molded assembly has a top surface and a bottom surface. The top surface and the bottom surface are prepared for receiving a pattern of conductive coatings, where the preparation includes removing the top and bottom conductive element portions such that the top and bottom surfaces have the dielectric material and planed ends of the conductive element middle portion. The conductive coating is applied, where the coating is disposed to connect the middle portion conductive element ends according to a conductive pattern, wherein the conductive pattern defines a primary coil and a secondary coil of the wideband planar transformer.

In one aspect of the invention, the displacement feature is a toroid shape.

According to another embodiment, the method of fabricating a wideband planar transformer includes providing a bottom mold that has a pattern of hole pairs disposed in a planar base of the bottom mold. Conductive elements are inserted to the holes, where the conductive elements are disposed vertically from the planar base forming conductive element pairs, and a bottom portion of the conductive elements are held by the bottom mold. At least one standoff element is inserted to the mold bottom, where the standoff element is made from a dielectric material. A ferrite material is disposed on the standoff element, where the ferrite material separates the conductive element pairs. A top mold is provided to the bottom mold, where the top mold spans the bottom mold such that the top mold and the bottom mold define a mold pair. The dielectric material is deposited to the mold pair to create a molded assembly, where the dielectric material envelopes a top portion of the conductive element and envelopes the ferrite element and the standoff element. The molded assembly is removed from the mold pair, where the molded assembly has a top surface and a bottom surface. The top and bottom surfaces are prepared for receiving a pattern of conductive coatings, where the preparation includes making planar the assembly top and bottom surfaces, such that ends of the conductive elements are even with the planar surfaces. The conductive coating is applied, where the coating is disposed to connect the conductive element ends according to a conductive pattern, wherein the conductive pattern defines a primary coil and a secondary coil of the wideband planar transformer.

In one aspect of the above embodiments the molds have a mold array, where the methods provide an array of the transformers. In another aspect, the ferrite element is an array of the ferrite elements. In another aspect, the transformer array is diced.

In one aspect of the above embodiments the ferrite element is a toroid shaped ferrite element, where the conductive element pair has a first element of the pair on an inside of the toroid and a second element of the pair on an outside of the toroid.

In another aspect of the above embodiments the conductive elements are selected from a group consisting of pins and drawn wire.

In a further aspect of the above embodiments the conductive pattern includes a pattern of generally teardrop-shape conductors arranged in a spiral pattern, where a narrow end of the teardrop is on an inside of the spiral and a large end of the teardrop is on an outside of the spiral.

In one aspect of the above embodiments the surface preparation is selected from a group consisting of plasma etching, machining, grinding and lapping.

In a further aspect of the above embodiments applying conductive coating includes photolithography.

In one aspect the above embodiments further include providing a center tap to the primary coil and a center tap to the secondary coil.

In one aspect the above embodiments further include providing an electrode pair for the primary coil and providing an electrode pair for the secondary coil, where a first electrode of the pair is on the bottom surface and a second electrode of the pair is on the top surface.

In one aspect the above embodiments further include providing a solder ball grid array for combining the transformer with an integrated circuit.

BRIEF DESCRIPTION OF THE FIGURES

The objectives and advantages of the present invention will be understood by reading the following detailed description in conjunction with the drawing, in which.

DETAILED DESCRIPTION OF THE INVENTION

Figure 1:
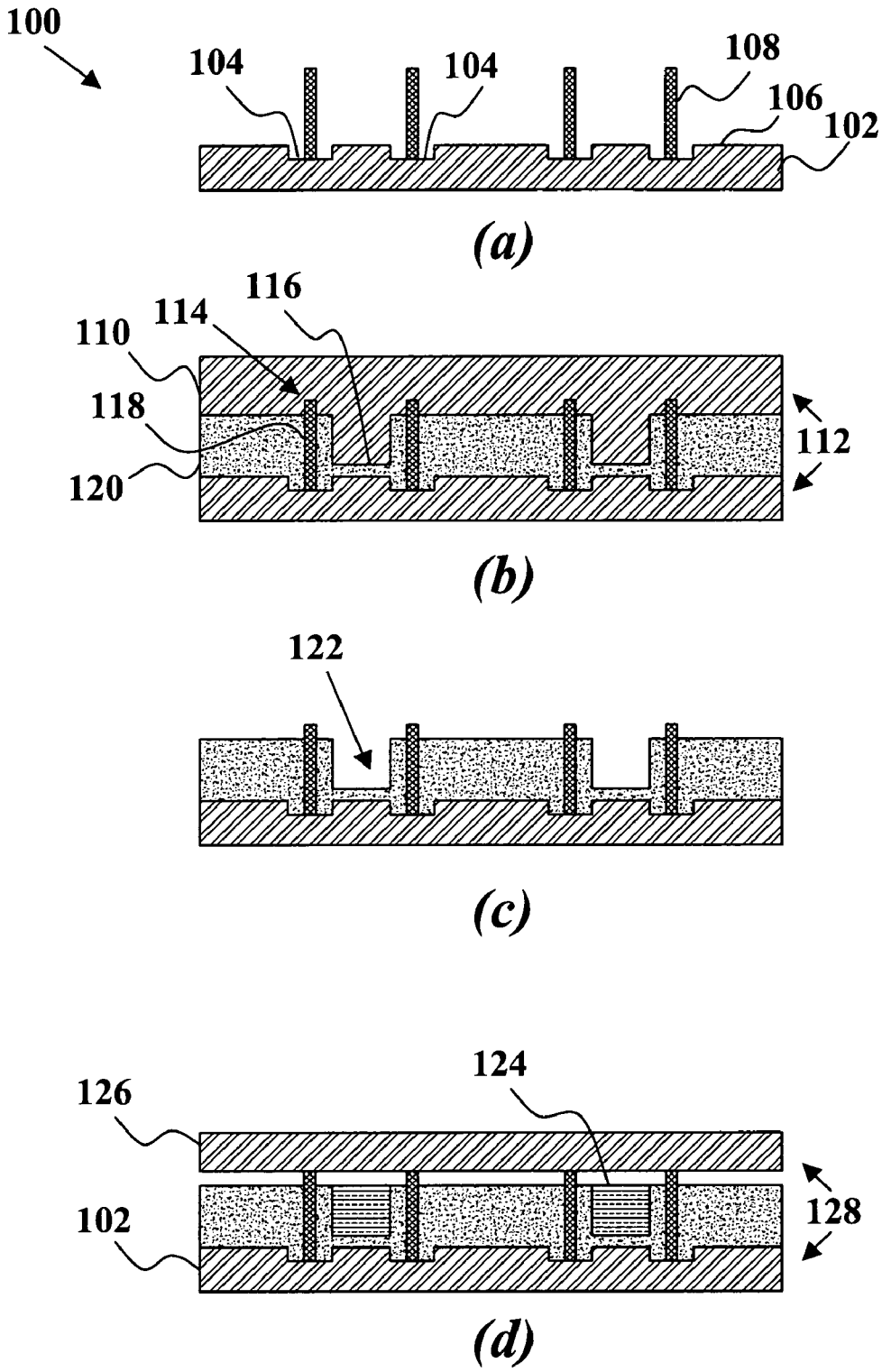
FIGS. 1*a*-1*g* show the steps of fabricating a planar transformer according to the present invention.
Figure 1:
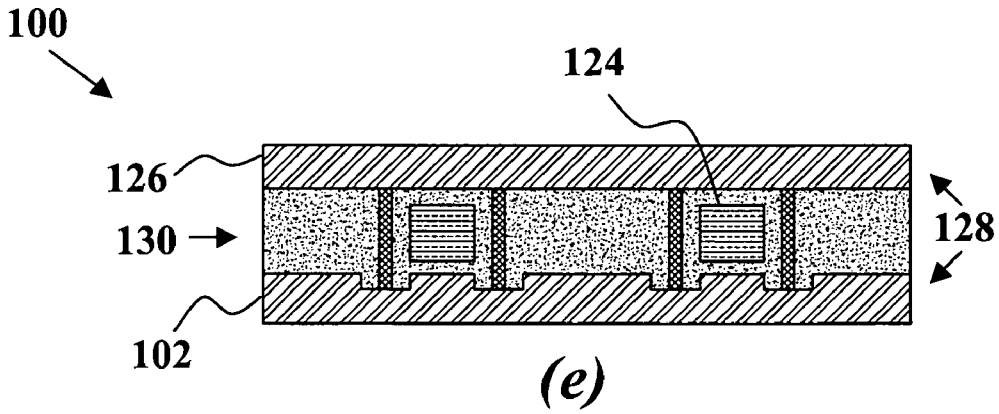
Figure 1:
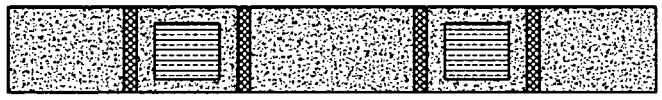
Figure 1:
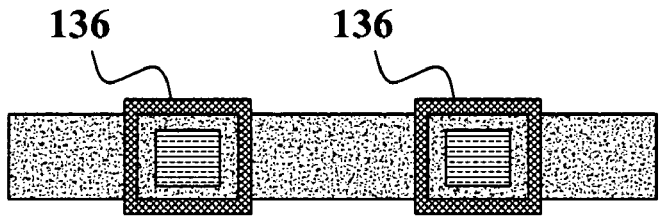

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

Creating a wideband planar transformer according to the current invention requires the use of several different concepts together in one design. The current method uses physical design and layout aspects that enable the conductors to be inter-wound around the ferrite material and adjacent conductors. In wideband applications, conductor spacing is critical as the frequency increases, where at low frequencies the ferrite material will provide sufficient coupling but at frequencies above several hundred megahertz the ferrite permeability begins to drop off dramatically and any coupling must come from the windings themselves. As frequency increases, the parasitic inter-winding capacitance and leakage inductance become dominant and significantly contribute to the changes in the optimal impedance. In hand-wound transformers, because the wires are not well positioned, the excessive parasitic capacitance and leakage inductance are induced at arbitrary values to change the optimal impedance. In the case of planar transformers having the primary and secondary coils placed separately on each side of the ferrite core, there is not enough electromagnetic coupling at high frequency where the permeability of the core drops dramatically. Therefore, to achieve a DC to GHz bandwidth transformer according to the current invention, turn spacing and width of the traces that control the coupling, inter-winding capacitance and leakage inductance are designed to combine the parasitic elements to achieve the optimal impedance for minimizing reflected energy.

At high a frequency, the leakage inductance is proportional to the trace width of the primary and secondary coils and the spacing between turns. The inter-winding capacitance depends on the spacing of the adjacent turns. The coupling comes from the inter-winding capacitance and mutual inductance. Similar to a conventional transmission line concept with distributed inductance and capacitance, the impedance of the line is proportional to the square root of the inductance and capacitance ratio. For a high frequency transformer, the parallel arrangement of the primary and secondary coils represents a pair of 2 coupled transmission lines that are wrapped around a ferrite element such as a toroid, for example. For this pair of the coupled transmission lines, the impedance is related to the ratio of distributed inductance over the capacitance and the coupling. Therefore, by designing specific gaps and trace widths, the parasitic leakage inductance and capacitance can be tuned to make the ratio of the impedance matched to the 100 ohm differential input and output impedance. When the impedance of the transformer is matched to the 100 ohm, the reflected energy is approaching zero or significantly minimized. The combination of the coupling and minimally reflected energy allows the transformer to have low insertion loss and DC to GHz performance.

The current invention uses a ferrite material that trades off high permeability at low frequencies with slightly higher permeability above several hundred megahertz. This allows the transformer to transfer energy efficiently over a wide range of frequencies. Most ferrite materials have a dramatic permittivity drop beginning at approximately 10 MHz which eliminates it from use in wideband applications.

The transformer of the current invention includes center taps on each side which allows the integrated circuit to switch energy from the line driver to the line side of the circuit. The center tap on the line side of the transformer along with a choke is added in order to make sure that the device can eliminate common mode energy. Excessive common mode energy will cause EMI emissions that will cause the device to fail FCC emissions requirements. Construction of the center taps so that the differential nature of the windings is maintained while eliminating the common mode energy on the line side requires strict adherence to spacing guidelines of the PCB traces. On the chip side of the transformer maintaining the impedance is critical to proper operation on the transmitter. The combination of an accurate spacing and an even number of turns provides very low differential to common signal conversion.

The layout of the wideband planar transformer invention requires that the adjacent primary and secondary turns are spaced at an appropriate distance to control the coupling, inter-winding capacitance, and leakage inductance. The trace width of the turns can also be designed together with spacing so that the total distributed inductance and capacitance of a transformer are matched to the 100 ohm differential input impedance. The matching to 100 ohm differential input impedance minimizes the reflected energy and increases the bandwidth from DC to multi-gigahertz. The number of turns is determined based on the core size and its permeability at the low frequency to meet the required minimal self-inductance. The self-inductance or the number of turns determines the lower cut off frequency while the layout and arrangement of the turns will maximize the high-end frequency of the bandwidth. Furthermore, the number of the turns must be an even number. On the primary side, one turn will be broken off to form a differential input. The center tap is connected to the center of the remaining turns and allows for an even number of turns on each side of the center tap. This configuration provides a total balance solution for the differential mode signals. Hence, the differential to common mode conversion is minimized and helps to reduce EMI.

Minimizing the various parasitic effects of the total solution, including packaging, is critical to wideband applications including. One embodiment of this device is to add copper pads on the lowest conductive layer of the PCB such that it may be attached directly to a linecard with a standard reflow manufacturing process when it is not embedded in a larger circuit.

The current invention uses a material that does not breakdown under the introduction to large voltage levels. Methods of manufacturing these transformers are discussed, such as casting, molding, etc.

According to one embodiment of the wideband planar transformer, the device has center taps on the chip and line sides of the devices. The width of the center tap can also be tuned to match the required system impedance. A ferrite material with a stable permittivity with respect to temperature and current is selected and embedded in a dielectric material. The low frequency permeability or initial permeability and the number of turns set the lower cut off frequency and permit operation to megahertz range. The conductors are intertwined around the embedded ferrite rather than separated as taught in prior art. Furthermore, the winding of the turns are well controlled in spacing and the width of the traces. The physical configuration of the top conductors is specifically selected to be a teardrop fashion to maximize the turns and lower the winding parasitic inductance. The primary and secondary turns are adjacent on top, bottom, and the 2 vertical conductor sides to have necessary coupling. Achieving low insertion, power, and return losses over a wide frequency is critical to proper operation of wideband transformers.

One embodiment can design the bottom PCB layout such that it becomes a device that may be used as a standalone component that could then be mounted utilizing industry standard PCB assembly processes.

Referring to the drawings, FIGS. 1*a*-1*g* show planar cutaway views of the general fabrication steps 100 of providing the wideband planar transformer invention. Shown in FIG. 1*a* is a bottom mold 102 that has a pattern of hole-pairs 104 disposed in a planar base 106 of the bottom mold 102. Conductive elements 108 are inserted to the holes 104, where the conductive elements 108 are disposed vertically from the planar base 106, and a bottom portion of the conductive elements are held by the bottom mold 102. In one aspect the conductive elements 108 may be conductive pins or drawn wire.

Shown in FIG. 1*b*, the method 100 further includes providing a first top mold 110 that is assembled (not shown) on the bottom mold 102 forming a first mold pair 112, where the first top mold 110 has conductive element receiving features 114 and a displacement feature 116 disposed between the conductive element receiving features 114, such that a middle portion 118 of the conductive elements 108 spans between the first top mold 110 and the bottom mold 102. A dielectric material 120 is deposited to the first mold pair 112 that envelopes the middle portion 118 of the conductive elements 108 and further envelopes the displacement feature 116.

Shown in FIGS. 1*c* and 1*d*, the first top mold 110 is removed, where a vacancy 122 is then revealed by removing the displacement feature 116. A ferrite element 124 is deposited to the vacancy 122. A second top mold 126 is provided is assembled (not shown) to the bottom mold 102, where the second top mold 126 and the bottom mold 102 define a second mold pair 128, and the second top mold 126 spans the bottom mold 102. In one aspect of the invention, the displacement feature 116 is a toroid shape and the ferrite element 124 is a toroid shaped, where the conductive element pair has 104 a first element of the pair on an inside of the toroid and a second element of the pair on an outside of the toroid.

Shown in FIG. 1*e* shows the dielectric material 120 further deposited to the second mold pair 128 to create a molded assembly 130, where the dielectric material 120 envelopes a top portion of the conductive element 108 and envelopes the ferrite element 124.

The molded assembly 130 is removed from the second mold pair 128, where the molded assembly 130 has a top surface 132 and a bottom surface 134 that are prepared for receiving a pattern of conductive coatings (see FIG. 1*g*), where the preparation includes removing the top and bottom conductive element portions such that the top 132 and bottom 134 surfaces have the dielectric material and planed ends of the conductive element middle portion along the same plane and are ready for the conductive coatings. The surface preparation may include plasma etching, machining, grinding or lapping.

FIG. 1*g* shows the conductive coating 136 is applied, where the coating is disposed to connect the middle portion conductive element ends according to a conductive pattern, wherein the conductive pattern defines a primary coil and a secondary coil of the wideband planar transformer.

In one aspect of the above embodiments the molds (102, 110, 126) may be a mold array, where the methods provide an array of the transformers (not shown). In another aspect, the ferrite element 124 is an array of the ferrite elements 124. In another aspect, the transformer array is diced (not shown).

Figure 2:
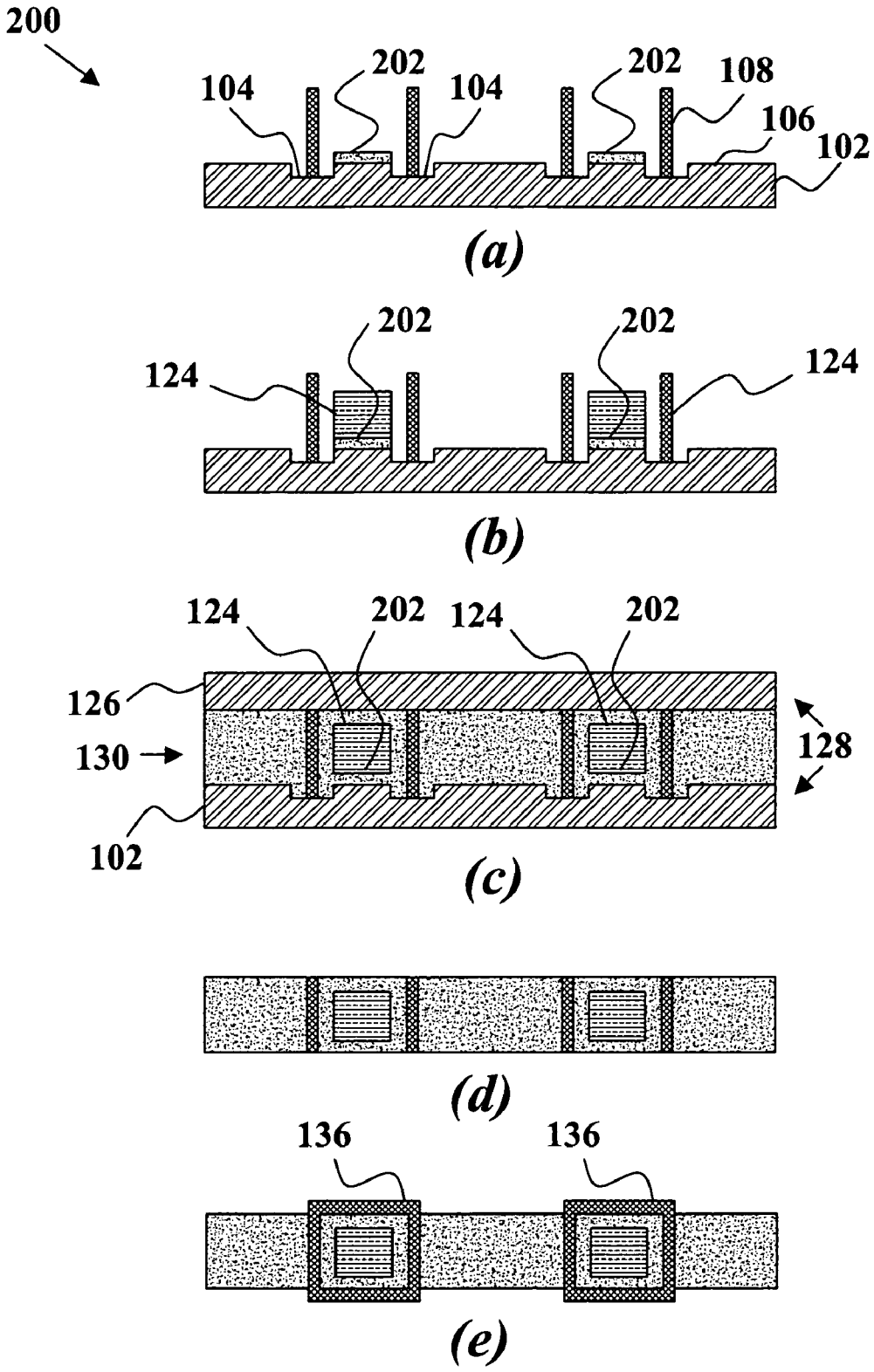
FIGS. 2*a*-2*e* show the steps of fabricating a planar transformer with a dielectric standoff according to the present invention.

FIGS. 2*a*-2*e* show planar cutaway views of general alternative embodiment steps 200 of fabricating the wide band planar transformer according to the current invention. Shown in FIG. 2*a* is the bottom mold 102 that has the pattern of hole-pairs 104 disposed in the planar base 106 of the bottom mold 102. Conductive elements 108 are inserted to the holes 104, where the conductive elements 108 are disposed vertically from the planar base 106, and a bottom portion of the conductive elements are held by the bottom mold 102. At least one standoff element 202 is inserted to the mold bottom 106, where the standoff element 202 is made from a dielectric material.

FIG. 2*b* shows the ferrite material 124 is then disposed on the standoff element 202, where the ferrite material 124 separates the conductive element pairs 104. In one aspect of the invention, the displacement feature 116 is a toroid shape and the ferrite element 124 is a toroid shaped, where the conductive element pair has 104 a first element of the pair on an inside of the toroid and a second element of the pair on an outside of the toroid. It should be evident that any closed loop circuitous shape.

FIG. 2*c* shows the top mold 124 provided to the bottom mold 102, and the top mold 126 spans the bottom mold 102.

FIG. 2*d* shows the dielectric material 120 further deposited to the mold pair 128 to create the molded assembly 130, where the dielectric material 120 envelopes a top portion of the conductive element 108 and the ferrite element 124, and combines with the dielectric standoff 202.

The molded assembly 130 is removed from the mold pair 128, where the molded assembly 130 has a top surface 132 and a bottom surface 134 that are prepared for receiving a pattern of conductive coatings, where the preparation includes removing the top and bottom conductive element portions such that the top 132 and bottom 134 surfaces have the dielectric material 120 and planed ends of the conductive element middle portion 118 along the same plane and are ready for the conductive coatings. The surface preparation may include plasma etching, machining, grinding or lapping.

FIG. 2*e* shows the conductive coating 136 is applied, where the coating is disposed to connect the middle portion conductive element ends according to a conductive pattern, wherein the conductive pattern defines a primary coil and a secondary coil of the wideband planar transformer.

Figure 3:
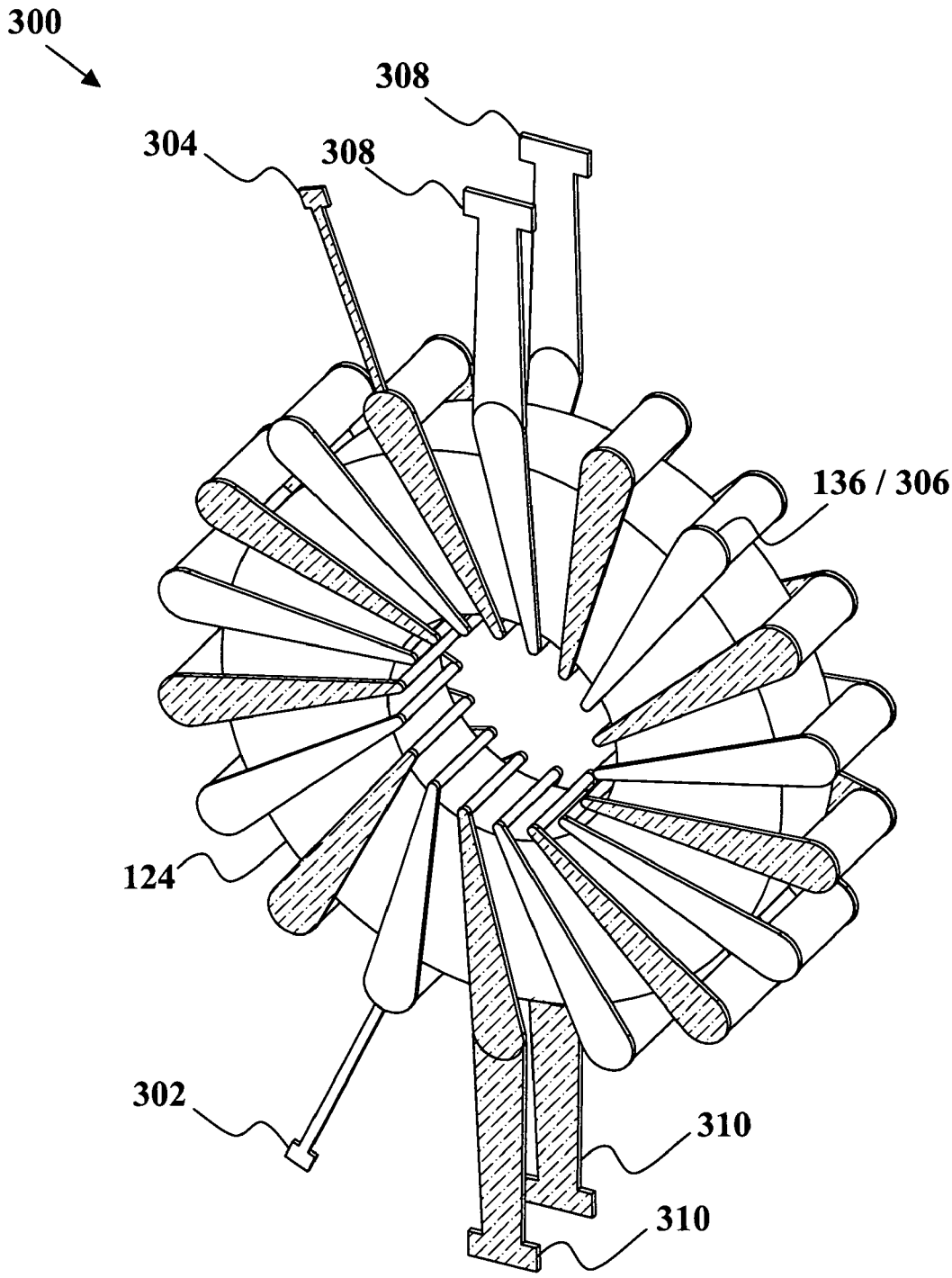
FIG. 3 shows perspective view of primary and secondary windings around a toroid ferric element of the planar transformer according to the present invention.

FIG. 3 shows perspective view of parallel windings of the primary and secondary coils around a toroid ferrite element 124 of the planar transformer 300 according to the present invention. The transformer 300 can further include a primary coil center tap 302 and secondary coil center tap 304.

The conductive coating 136 is configured in a pattern that includes a generally teardrop-shape conductors 136/306 arranged in a spiral pattern and applied by methods such as photolithography, where a narrow end of the teardrop is on an inside of the spiral and a large end of the teardrop is on an outside of the spiral. The primary and secondary conductors are adjacent all around the ferrite core.

In one aspect the above embodiments further include providing a primary coil electrode pair 308 and providing a secondary coil electrode pair 310, where a first electrode of the pair is on the bottom surface and a second electrode of the pair is on the top surface, whereas the primary coil and secondary coil (shown in grey) are generally parallel coils having coil spacing and coil widths optimized to control leakage inductance and winding capacitance to lower reflected energy and extend bandwidth from DC to GHz.

The methods according to the current invention enable varying the number of coil windings for the primary and secondary coils.

In one aspect the above embodiments further include providing a solder ball grid array (not shown) for combining the transformer 300 with an integrated circuit (not shown).

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For example, the differential input and output of the primary and secondary turns and the center taps can set at top, bottom, or any locations around the winding. The top and bottom conductors can be attached to a polyimide films that are then laminated onto the molded structure. The transformer can be surface mounted onto a PCB using solder or BGA, can be packaged or integrated with other components. All such variations are considered to be within the scope and spirit of the present invention as defined by the following claims and their legal equivalents.

All such variations are considered to be within the scope and spirit of the present invention as defined by the following claims and their legal equivalents.

What is claimed:

1. A wideband planar transformer comprising:

a. a ferrite material wherein said ferrite material has a closed-loop circuitous shape; and b. a pair of balanced symmetric coupled transmission lines inter-wound about said ferrite material, wherein said pair of balanced symmetric coupled transmission lines comprises a capacitance between each said transmission line and a mutual inductance between each said transmission line, wherein said pair of coupled transmission lines form a pair of balanced symmetric coupled differential lines, wherein said pair of balanced symmetric coupled transmission lines inter-wound about said ferrite material provide a distributed inductance about said ferrite material, wherein trace widths of each said transmission line and gaps between said pair of balanced symmetric coupled transmission lines are matched to provide said differential coupling across a range from DC to multi-GHz, wherein said pair of coupled differential lines have an impedance proportional to a ratio of said distributed inductance over said coupling capacitance, wherein said ratio is disposed to match a differential input impedance and a differential output impedance in said wideband planar transformer, wherein each said transmission line comprises a specific impedance, wherein said specific impedance is dependent on an inductance of each said line and a capacitance of each said line.

2. The wideband planar transformer of claim 1, wherein said closed-loop circuitousshape comprises a toroid shape, wherein said coupled transmission lines comprise teardrop-shape conductors arranged with a small teardrop end near a center of said ferrite material and a large teardrop end away from said center of said ferrite material.

3. The wideband planar transformer of claim 2, wherein said conductive elements are disposed inside said ferrite material and outside said ferrite material, wherein said inside conductive elements are connected to said small teardrop end and said outside conductive elements are connected to said large teardrop end.

4. The wideband planar transformer of claim 1, wherein said coupled transmission lines comprise teardrop-shape conductors, wherein said teardrop-shape conductors comprise conductive coatings that form generally parallel said coupled transmission lines, wherein said coupled transmission lines comprise primary and secondary coils, wherein a coil spacings and coil widths are optimized to control leakage inductance and winding capacitance to lower reflected energy.

5. The wideband planar transformer of claim 1 wherein said coupled transmission lines comprise a primary coil and a secondary coil, wherein a first center tap is connected to a center coil of said primary coil and a second center tap is connected to a center coil of said secondary coil, wherein each half of each said coupled transmission line is made symmetric by said first center tap and said second center tap.

6. The wideband planar transformer of claim 1, wherein said coupled transmission lines are disposed to provide voltage isolation while maintaining said impedance.

* * * * *